US009015892B1

(12) United States Patent
Figel

(10) Patent No.: US 9,015,892 B1
(45) Date of Patent: Apr. 28, 2015

(54) CORNER-MOUNTED SHOWER BRUSH

(71) Applicant: Mare Figel, Orlando, FL (US)

(72) Inventor: Mare Figel, Orlando, FL (US)

( * ) Notice: Subject to any disclaimer, the term of this patent is extended or adjusted under 35 U.S.C. 154(b) by 0 days.

(21) Appl. No.: 14/474,893

(22) Filed: Sep. 2, 2014

(51) Int. Cl.
*A47K 7/02* (2006.01)

(52) U.S. Cl.
CPC ..... *A47K 7/024* (2013.01); *A46B 2200/1006* (2013.01)

(58) Field of Classification Search
CPC ..... A47K 7/022; A47K 7/024; A61H 7/00; A61H 7/002; A61H 2205/081; A46B 9/00; A46B 9/02; A46B 15/00; A46B 2200/1006
USPC ..... 15/104.92, 160; 4/606; 601/136; D4/130; D28/63
See application file for complete search history.

(56) References Cited

U.S. PATENT DOCUMENTS

| | | | | |
|---|---|---|---|---|
| 3,279,463 | A | 10/1966 | Krimmel | |
| 3,612,044 | A * | 10/1971 | Gurrola | 601/136 |
| 4,733,421 | A | 3/1988 | Kuersteiner | |
| D400,658 | S | 11/1998 | Mejia, Sr. | |
| 6,110,132 | A | 8/2000 | Kurpieski | |
| 6,427,279 | B1 * | 8/2002 | White et al. | 15/104.92 |
| 6,526,618 | B1 | 3/2003 | Bolton | |
| 6,647,564 | B1 * | 11/2003 | Smith | 4/606 |
| 7,011,639 | B1 | 3/2006 | Viglietti | |
| 7,467,438 | B2 | 12/2008 | Ryman | |
| D592,369 | S | 5/2009 | Hitzemann | |
| D654,627 | S | 2/2012 | Anderson | |

FOREIGN PATENT DOCUMENTS

GB 1442570 * 7/1976

* cited by examiner

*Primary Examiner* — Mark Spisich

(57) ABSTRACT

The bodily scrubbing assembly includes a housing that may be mounted within a shower. A plurality of suction cups is coupled to the housing. The suction cups are configured to engage the shower. The housing is retained in the shower. A plurality of bristles is coupled to the housing. The plurality of bristles may scrub a user's body.

13 Claims, 4 Drawing Sheets

CORNER-MOUNTED SHOWER BRUSH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shower brushes, more specifically, corner-mounted shower brushes.

SUMMARY OF THE INVENTION

An embodiment of the disclosure meets the needs presented above by generally comprising a housing that may be mounted within a shower. A plurality of suction cups is coupled to the housing. The suction cups is configured to engage the shower. The housing is retained in the shower. A plurality of bristles is coupled to the housing. The plurality of bristles may scrub a user's body.

An object of the invention is to provide a device that is corner mounted shower brush.

These together with additional objects, features and advantages of the corner-mounted shower brush will be readily following detailed description of presently preferred, but nonetheless illustrative, embodiments of the corner-mounted shower brush when taken in conjunction with the accompanying drawings.

In this respect, before explaining the current embodiments of the corner-mounted shower brush in detail, it is to be understood that the corner-mounted shower brush is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of corner-mounted shower brush.

It is therefore important that the claims be regarded as including such equivalent construction insofar as they do not depart from the spirit and scope of corner-mounted shower brush. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
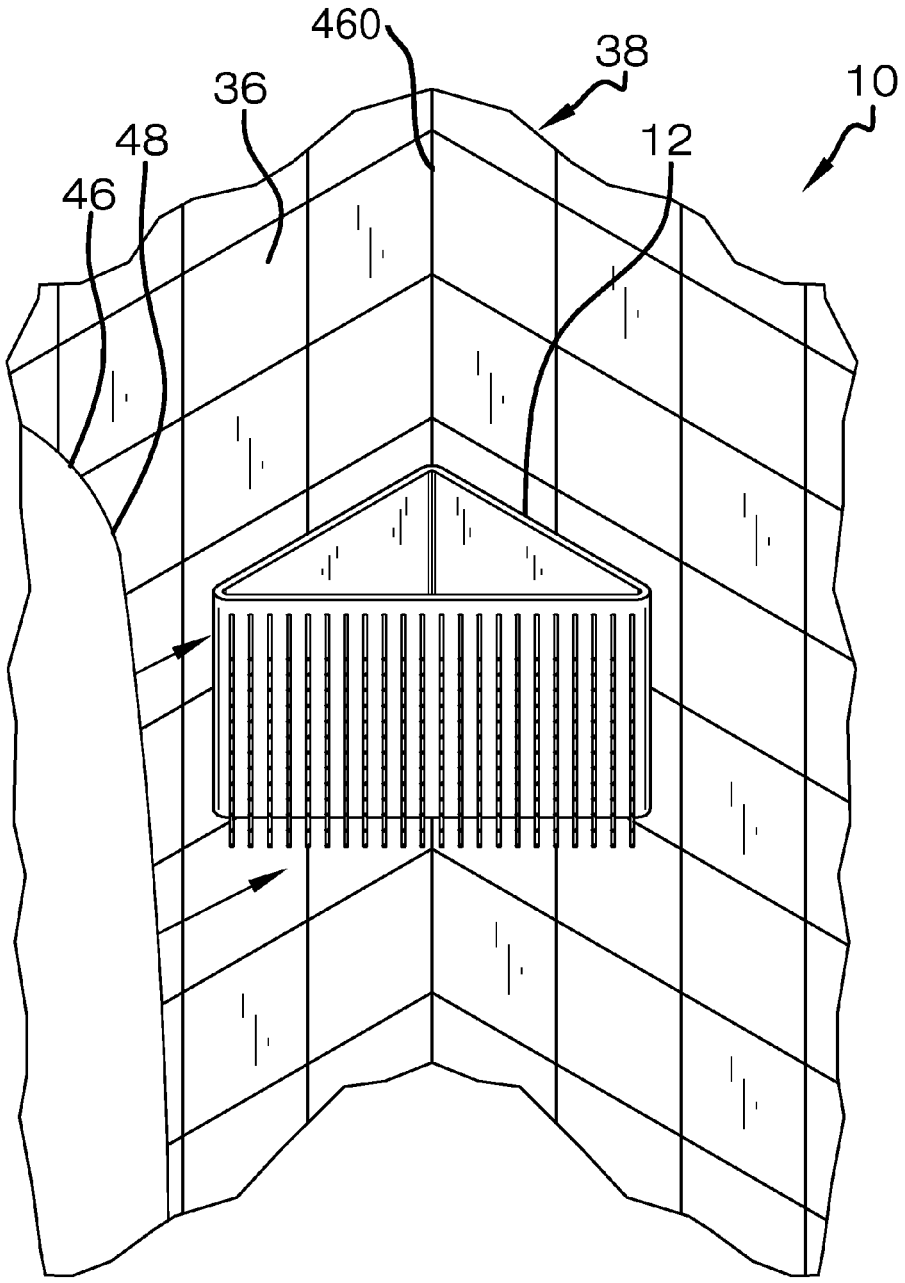
FIG. 1 is a front perspective view of a bodily scrubbing assembly according to an embodiment of the disclosure.
Figure 2:
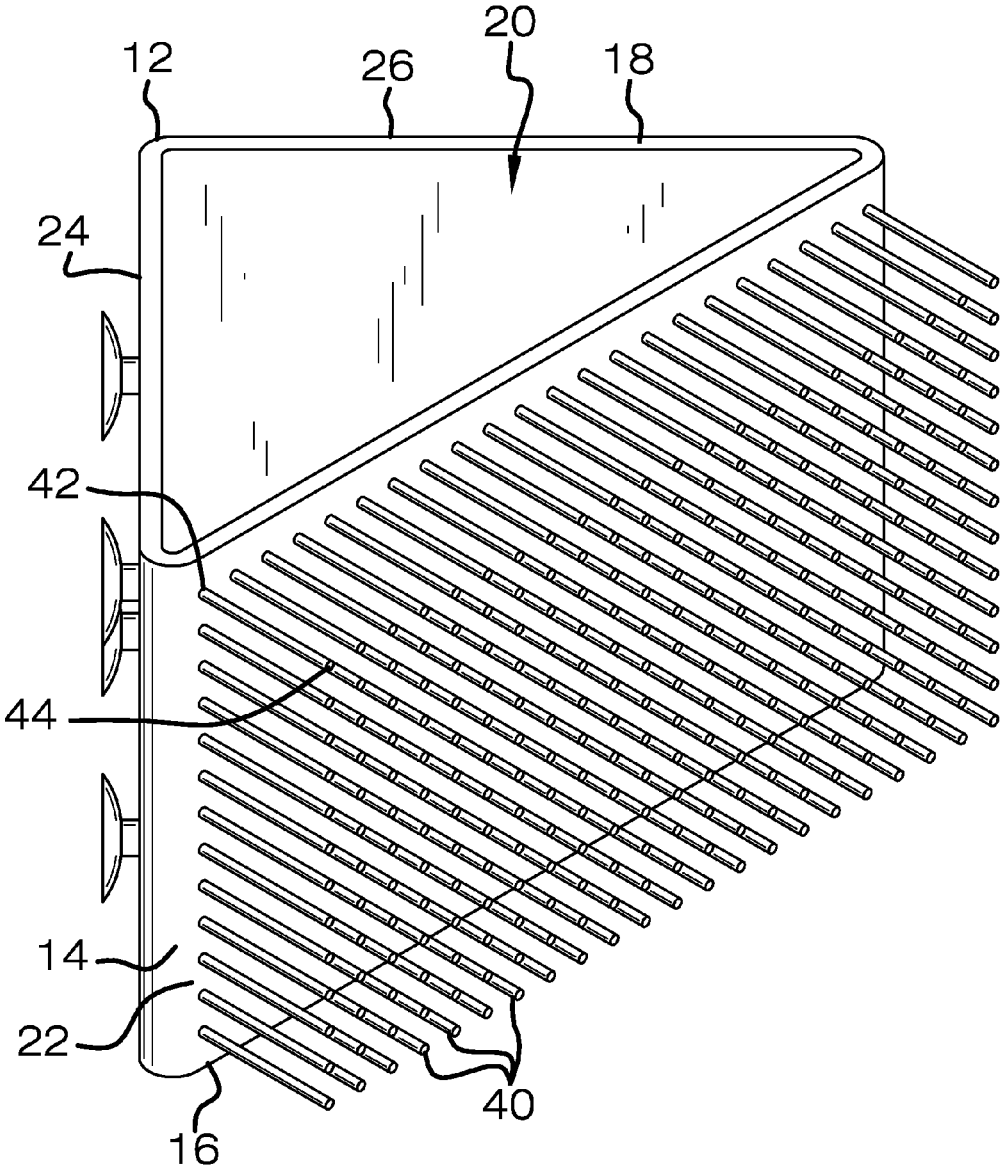
FIG. 2 is a perspective view of an embodiment of the disclosure.
Figure 3:
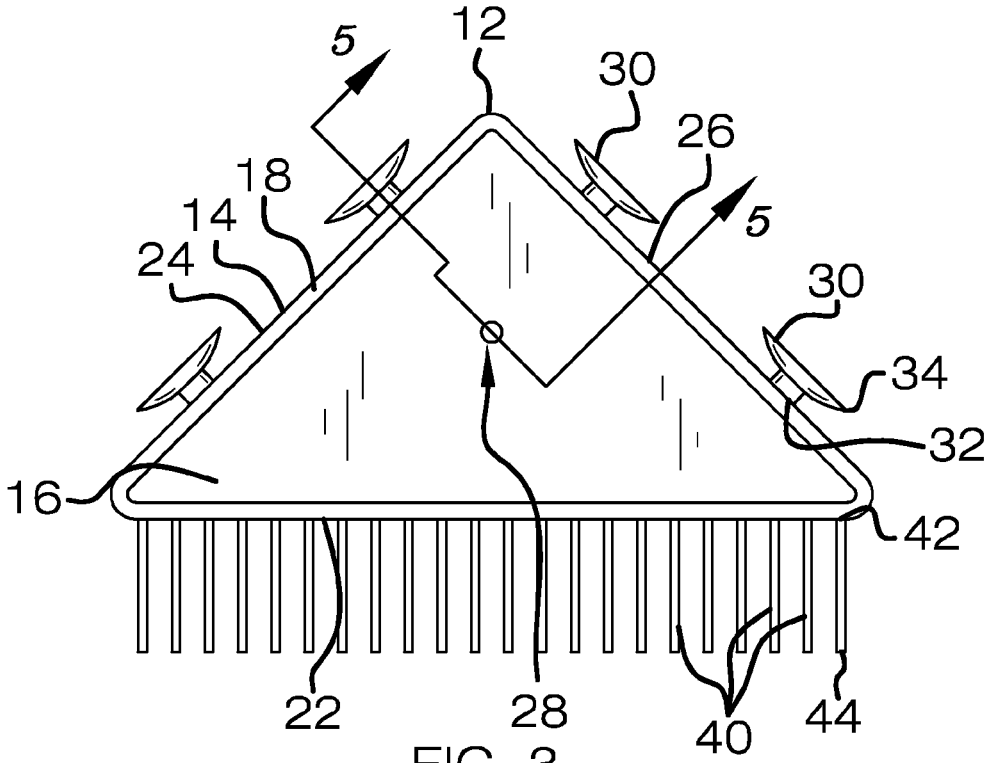
FIG. 3 is a top view of an embodiment of the disclosure.
Figure 4:
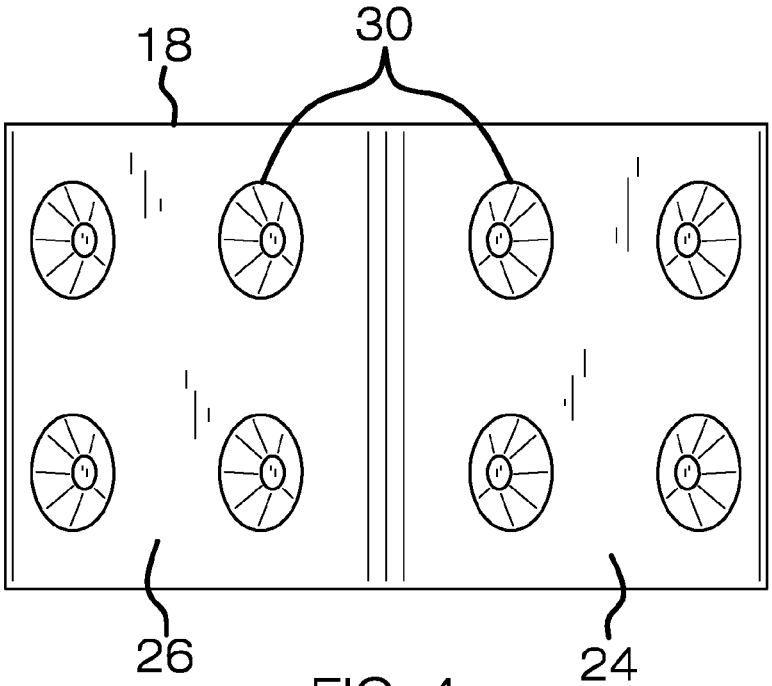
FIG. 4 is a back view of an embodiment of the disclosure.
Figure 5:
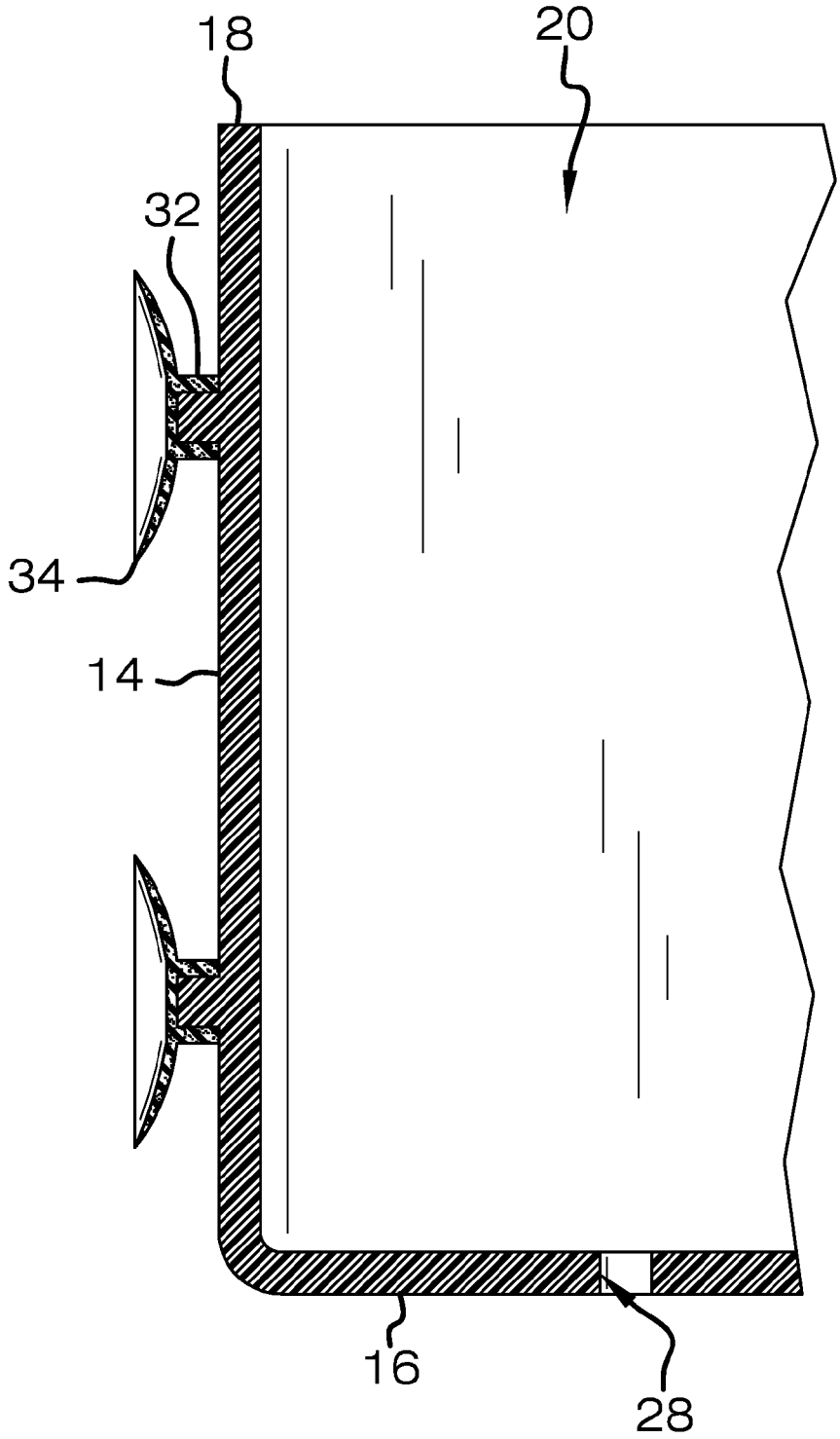
FIG. 5 is a cross sectional view taken along line 5-5 of FIG. 3 of an embodiment of the disclosure.

As best illustrated in FIGS. 1 through 5, the bodily scrubbing assembly 10 generally comprises a housing 12. The housing 12 has a perimeter wall 14 coupled to and extending upwardly from a bottom wall 16 of the housing 12. The perimeter wall 14 of the housing 12 has a top edge 18. The top edge 18 of the perimeter wall 14 of the housing 12 defines an opening 20 into the housing 12.

The perimeter wall 14 of the housing 12 has a front side 22, a first oblique side 24 and a second oblique side 26. Moreover, the perimeter wall 14 of the housing 12 defines a triangular shape. The bottom wall 16 of the housing 12 has a drainage hole 28 extending therethrough. The drainage hole 28 the housing 12 to drain.

A plurality of suction cups 30 is provided. The plurality of suction cups 30 each has a fastened end 32 and an engaging end 34. The engaging end 34 of each of the suction cups 30 has a diameter that is greater than a diameter of the fastened end 32 of the suction cups 30.

The plurality of suction cups 30 is coupled to the perimeter wall 14 of the housing 12. The plurality of suction cups 30 is evenly distributed on the first 24 and second 26 oblique sides of the perimeter wall 14 of the housing 12. The engaging end 34 of the suction cups 30 engage a wall 36 in a shower 38 so the housing 12 is retained on the wall 36 in the shower 38. The shower 38 may be a bathing shower of any conventional design.

A plurality of bristles 40 is provided. Each of the bristles 40 has a coupled end 42 and a free end 44. The free end 42 of the bristles 40 is each coupled to the front side 22 of the perimeter wall 14 of the housing 12. The bristles 40 are evenly spaced apart and distributed along an entire height and width of the front side 22 of the perimeter wall 14 of the housing 12. The plurality of bristles 40 may scrub a user's body 46.

In use, the housing 12 is positioned within a corner 460 in the shower 38. Additionally, the housing 12 is positioned at a selected height with respect to the user's body 46. The user 48 rubs the user's body 46 against the free end 44 of the bristles 40 while the user 48 bathes.

With respect to the above description, it is to be realized that the optimum dimensional relationship for the various components of the bodily scrubbing assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the bodily scrubbing assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A bodily scrubbing assembly comprising:

a housing configured to be mounted within a shower;

a plurality of suction cups coupled to said housing, said suction cups engaging the shower such that said housing is retained in the shower; and a plurality of bristles coupled to said housing such that said plurality of bristles are configured to scrub a user's body;

wherein said housing having a perimeter wall coupled to and extending upwardly from a bottom wall of said housing;

wherein said perimeter wall of said housing having a front side, a first oblique side and a second oblique side such that said perimeter wall of said housing defines a triangular shape.

2. The assembly according to claim 1, wherein said perimeter wall of said housing having a top edge.

3. The assembly according to claim 1, wherein said plurality of suction cups being coupled to said perimeter wall of said housing.

4. The assembly according to claim 3, wherein said plurality of suction cups being evenly distributed on said first and second oblique sides of said perimeter wall of said housing.

5. The assembly according to claim 1, wherein said plurality of bristles each having a coupled end and a free end.

6. The assembly according to claim 1, wherein a coupled end of said bristles each being coupled to said front side of said perimeter wall of said housing.

7. The assembly according to claim 6, wherein said bristles being evenly spaced apart and distributed along an entire height and width of said front side of said perimeter wall of said housing.

8. A bodily scrubbing assembly comprising:

a housing having a perimeter wall coupled to and extending upwardly from a bottom wall of said housing, said housing being configured to be mounted within a shower;

a plurality of suction cups coupled to said housing, said suction cups engaging the shower such that said housing is retained in the shower;

a plurality of bristles coupled to said housing such that said plurality of bristles are configured to scrub a user's body;

wherein said perimeter wall of said housing having a top edge;

wherein said top edge of said perimeter wall of said housing defining an opening into said housing;

wherein said perimeter wall of said housing having a front side, a first oblique side and a second oblique side such that said perimeter wall of said housing defines a triangular shape.

9. The assembly according to claim 8, wherein said plurality of suction cups being coupled to said perimeter wall of said housing.

10. The assembly according to claim 8, wherein said plurality of suction cups being evenly distributed on said first and second oblique sides of said perimeter wall of said housing.

11. The assembly according to claim 8, wherein said plurality of bristles each having a coupled end and a free end.

12. The assembly according to claim 8, wherein a coupled end of said bristles each being coupled to said front side of said perimeter wall of said housing.

13. The assembly according to claim 8, wherein said bristles being evenly spaced apart and distributed along an entire height and width of said front side of said perimeter wall of said housing.

* * * * *